United States Patent [19]

Bora, Jr.

[11] 4,335,731

[45] Jun. 22, 1982

[54] DEVICE FOR ORAL HYGIENE CARE

[76] Inventor: F. William Bora, Jr., 404 Gulph Rd., Narberth, Pa. 19072

[21] Appl. No.: 156,930

[22] Filed: Jun. 6, 1980

Related U.S. Application Data

[63] Continuation of Ser. No. 927,869, Jul. 25, 1978, abandoned.

[51] Int. Cl.[3] ..... A45D 44/18

[52] U.S. Cl. ..... 132/84 R; 132/89

[58] Field of Search ..... 132/89, 93, 84 R, 92; 15/104.94

[56] References Cited

U.S. PATENT DOCUMENTS

| | | | |
|---|---|---|---|
| 1,989,895 | 2/1935 | Gilder | 132/93 |
| 3,070,102 | 12/1962 | MacDonald | 15/104.94 |
| 3,124,824 | 3/1964 | Lutz | 15/104.94 |
| 3,368,668 | 2/1968 | Micciche | 15/227 |
| 3,447,181 | 6/1969 | Coker et al. | 15/104.94 |
| 3,902,509 | 9/1975 | Tundormann | 132/84 R |
| 3,905,113 | 9/1975 | Jacob | 132/84 R |

FOREIGN PATENT DOCUMENTS

| | | | |
|---|---|---|---|
| 1903020 | 8/1970 | Fed. Rep. of Germany | 132/84 R |

*Primary Examiner*—G. E. McNeill

*Attorney, Agent, or Firm*—Harding, Earley & Follmer

[57] ABSTRACT

A disposable device for cleaning teeth is composed of a flexible, soft honeycombed sheet. Bristles composed of integral fibers extend outward from the exposed surface of the sheet. The sheet is secured over the finger which is used for massage of the user's gums and cleaning of the user's teeth. In its preferred form, the sheet is impregnated with a dentifrice.

5 Claims, 14 Drawing Figures

DEVICE FOR ORAL HYGIENE CARE

This is a continuation of application Ser. No. 927,869, filed July 25, 1978, now abandoned.

BACKGROUND OF THE INVENTION

Disposable devices containing a dentifrice and which can be secured to a finger for cleaning teeth are well known in the art as seen from U.S. Pat. Nos. 1,157,413; 1,611,510; 2,092,987; 2,318,365; 2,761,166; 2,966,691; 2,999,206; 3,018,498; 3,070,102; 3,124,824; 3,176,388; 3,298,507; 3,368,668; 3,675,264; 3,902,509 and 3,934,299. In order to properly clean teeth it is important to having a cleaning vehicle with soft bristles carrying a dentifrice to the teeth so that plaques which lead to dental caries can be removed from interdental areas as well as from the gingival margins. The use of conventional fabrics such as the pile fabric of U.S. Pat. No. 1,157,413, is an inadequate substitute for the bristles of a conventional tooth brush. This is also recognized in the tooth cleaning devices disclosed in U.S. Pat. Nos. 3,070,102, and 3,368,668. In U.S. Pat. No. 3,070,102, the device incorporates a bristle brush 6 while the device of U.S. Pat. No. 3,368,668 similarly incorporates a bristle brush 17. These latter two devices are difficult to make and are relatively expensive for a disposable tooth cleaning device. The prior art set forth above which employ plastics such as the device of U.S. Pat. 3,124,824 suffer from the absence of bristles. This invention solves the problem of the prior art by providing a device using a honeycombed sheet of polyurethane fibers, for example, a reticulated polyurethane foam having outwardly extending bristles on its outer surface integral with the interconnected polyurethane fibers of the foam. The digital feedback of the device of the invention is superior to the prior art because the soft texture of the foam permits more accurate control of the pressure used to clean the teeth. Further, greater amounts of dentifrice can be stored in the honeycombed polyurethane material because the sheet is largely air, for example, 97% air. The polyurethane sheet wrapped around a finger and attached to itself by an adhesive strip is an important new mechanical advantage over previously described wipes because of its fitting adaptability.

BRIEF SUMMARY OF THE INVENTION

A disposable device for cleaning teeth is a flexible honeycombed sheet formed of polymer fibers, for example, a reticulated or non-reticulated polyurethane foam. Bristles integral with said fibers extend outwardly from the outer face of the sheet. The sheet is secured to a finger with the inner face of the sheet against the finger for manipulation of the outer face against the user's teeth and gums. Advantageously, the device takes the form of a finger receiving pocket. In its preferred form, the sheet is impregnated with dentifrice.

Each pore of the honeycombed sheet can be controlled over a wide range of between 10 to 100 cells per 1 linear inch, giving great latitude to the texture of the material, which is largely open space, for example, 97% open space and only 3% actual material. Any of the well known powdered or paste dentifrices are suitable for impregnating the honeycombed sheet.

Advantageously, each pore of the honeycombed sheet will have a maximum dimension of from about 0.2 to about 6 mm., advantageously from about 0.5 to about 4 mm. Advantageously, the bristles will have a length of from about 0.1 to about 3 mm., preferably from about 0.4 mm. to about 2 mm.

DETAILED DESCRIPTION

Figure 1A:
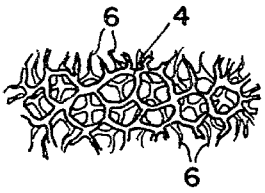
FIG. 1*a* is an enlarged side view a portion of the sheet in FIG. 1 without any dentifrice showing reticulated polyurethane foam.

A device 2 for cleaning teeth has a rectangular sheet 4 (FIG. 1) of soft reticulated polyurethane foam with bristles 6 extending from the top and bottom surfaces of the sheet as best seen in FIG. 1*a*. At one edge of this sheet is a paper or plastic strip 10 having a contact adhesive 12 on both sides and covered by a paper or plastic peel away cover strip 14. An overhanging tag 16 is part of the peel away cover 14 for the adhesive, so that the strip 14 covering the adhesive may be easily removed. The rectangular sheet 4 of polyurethane is impregnated with a dentifrice 20.

Figure 2:
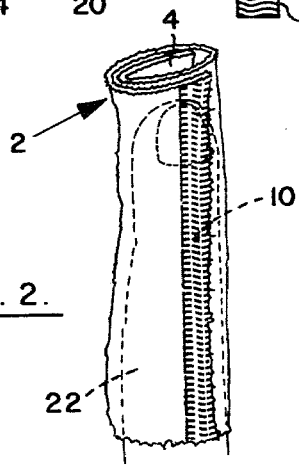
FIG. 2 is a view of the device in FIG. 1 applied to a finger prior to use.

To use the device 2, the cover strip 14 is peeled away from the adjacent adhesive 12 to expose said adhesive. The polyurethane sheet 4 is wrapped around an index finger 22 as shown in FIG. 2. The polyurethane sheet 4 is secured to form a pocket for the index finger by attaching itself to the uncovered adhesive 12. The device 2 with the finger inside is used to rub against the user's teeth and gums (gingival), releasing the dentifrice 20 which cleans the teeth as the gums are massaged. The bristles 6 provide adequate cleaning in the interdental areas and at the gingival line. Sensory endings in the finger pulp quantitate cleaning pressure, thereby eliminating enamel erosion and cementum abrasion, frequent complications of toothbrush use for dental care.

Figure 1B:
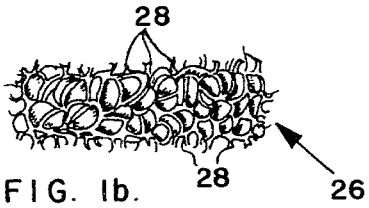
FIG. 1*b* is an enlarged side view of an alternative sheet using non-reticulated polyurethane foam.
Figure 1:
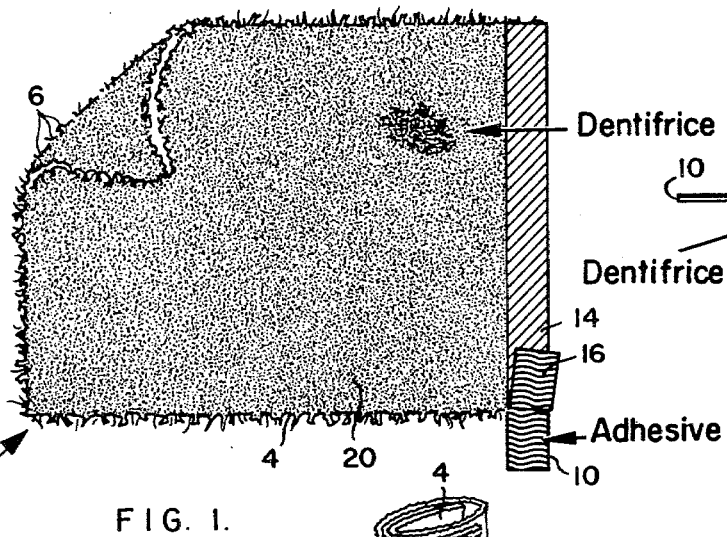
FIG. 1 is a plan view of a rectangular sheet of foam with an adhesive strip in accordance with the invention.
Figure 3:
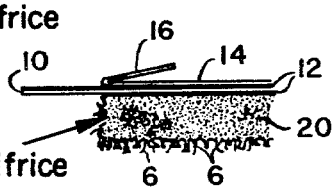
FIG. 3 is a side view partially broken away, of the rectangular sheet in FIG. 1 with straps covering the adhesive layers and tags of the covering material extending from the edge of the sheet.

As shown in FIG. 1*b*, a non-reticulated polyurethane foam sheet 26 having integral bristles 28 can be substituted for sheet 4.

Figure 4A:
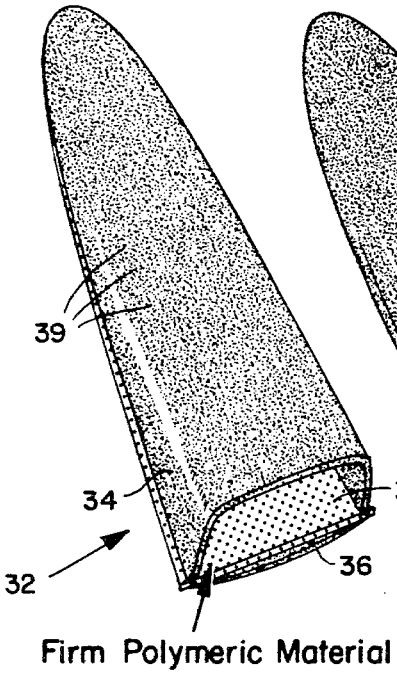
FIG. 4*a* is a top perspective of a finger cott for cleaning teeth: 3 layers, the top and bottom flexible and the inner layer firm.

As shown in FIG. 4*a*, an alternate device for this category of dental wipes for cleaning teeth is a finger cott 32 which has a "U" shaped sheet 34 and a sheet 36 which are secured together at their edges as by heat sealing with a sheet 38 between them to form a finger stall for the reception of an index finger. The sheets 34 and 36 are flexible reticulated polyurethane foam or flexible non-reticulated polyurethane foam or a combination of both. Sheet 38 is substantially firmer than sheets 36 and 38 and of, for example, a firm polymeric material. The outer surface of cott 32 has bristles (not shown) extending outwardly from the surface consisting of polyurethane fibers in the same manner as shown in FIG. 1*a*. The bristles are part of the polymer forming the sheet. A dentifrice indicated at 39 permeates the sheet 34. The sheets 34 and 36 which form the cott 32 may be of the same material as the polyurethane sheet 4, or may be composed of another polymeric material. The user's finger is inserted between the sheets 34 and 36 or between sheets 36 and 38 and is then used in the same manner as described above.

Figure 4B:
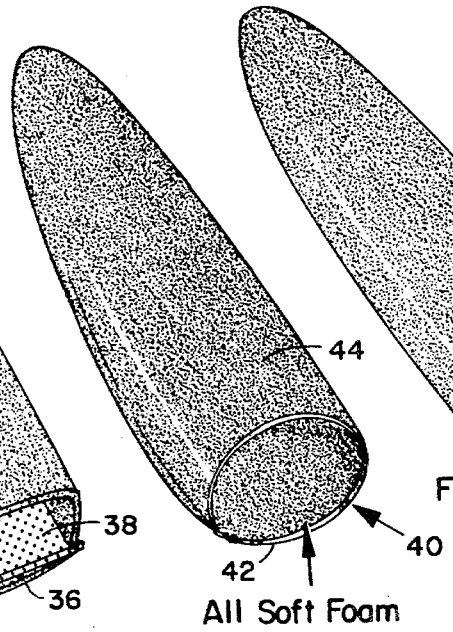
FIG. 4*b* is a top perspective of a flexible finger cott.

As shown in FIG. 4*b*, a finger cott 40 is formed from a sheet 42 of honeycombed polyurethane such as that shown in FIGS. 1*a* or 1*b* impregnated with a dentifrice 44 and with sheet 42 being wrapped into a generally tubular shape and its side edges heat sealed together.

Figure 4C:
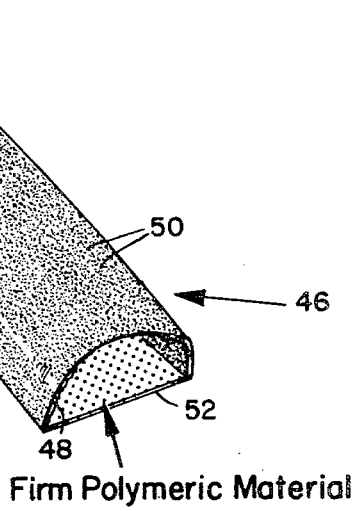
FIG. 4*c* is a top perspective of a cott; the upper layer is a soft flexible material and the bottom layer is a firm material.

As shown in FIG. 4*c*, a cott 46 has a sheet 48 of a honeycombed material such as that disclosed in FIGS. 1*a* or 1*b* impregnated with a dentifrice 50 and formed into an inverted "U" shape with its edges heat sealed to a firm polymeric material sheet 52.

Figure 5A:
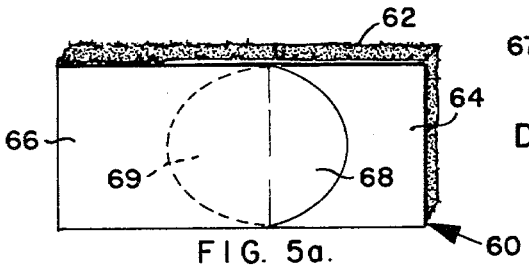
FIG. 5*a* is a top view of a dental wipe patch with an adhesive cover on top.
Figure 5B:
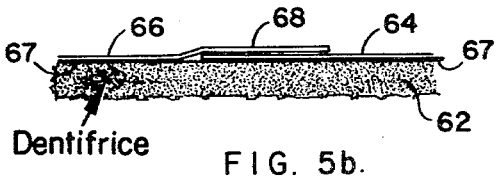
FIG. 5*b* is a side view of the dentail wipe patch of FIG. 5*a* showing strips covering the adhesive on top.

As shown in FIGS. 5*a* and 5*b*, an alternative dental wipe 60 is composed of a rectangular sheet 62 of the reticulated or non-reticulated polyurethane foam described above. Sheet 62 has overlapping removable cover strips 64 and 66 over a contact adhesive 67 on the back of sheet 62. On removal of the cover strips, the adhesive is secured against a finger for use. Cover strips 64 and 66 have tag ends 68 and 69 for ease of removal.

Figure 6A:
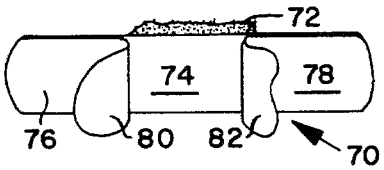
FIG. 6*a* is a top view of a dental wipe using adhesive strips to attach the cleaning soft flexible material to the finger.
Figure 6B:
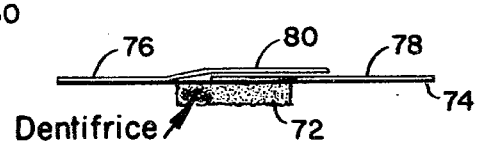
FIG. 6*b* is a side view of the wipe in FIG. 6*a* showing the cover of the adhesive strips on top.

As shown in FIG. 6*a*, a wipe 70 has a sheet 72 of honeycombed material such as disclosed above to which is adhesively secured an adhesive strap 74 like a bandaid provided with overlapping protecting removable covers 76 and 78, covers 76 and 78 having tag ends 80 and 82, respectively, to facilitate removal. After covers 76 and 78 are removed, strip 74 is wrapped around a finger with sheet 72 facing outwardly and adhesively secured to the finger and itself in the manner of a bandaid.

Figure 7:
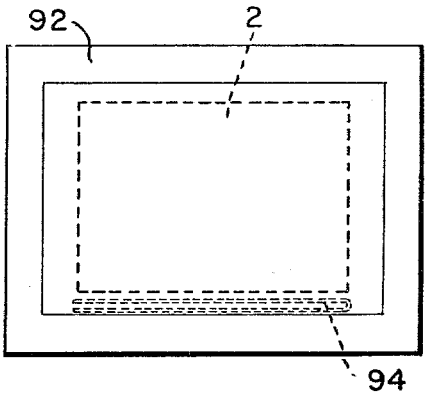
FIG. 7 is a plan view of the inventive dental wipe enclosed within a sterile paper container which also encloses a piece of dental floss.

FIG. 7 shows a dental wipe 2 packaged separately and enclosed within a sterile paper packet 92, with a piece of dental floss 94 included within packet 92. A number of wipes 2, for example 12, may be placed in a single packet.

Figure 9:
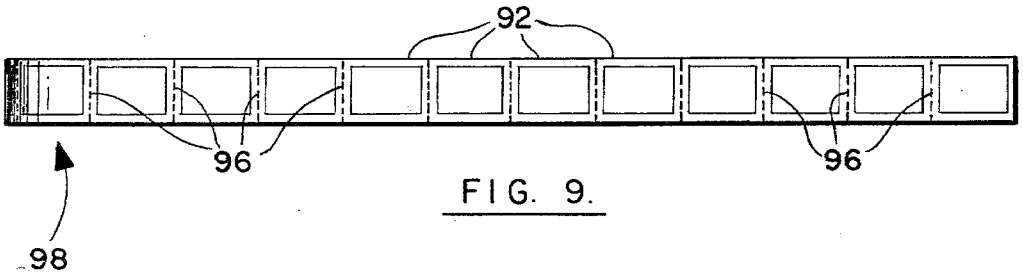
FIG. 9 is a top plan view of FIG. 8.
Figure 8:
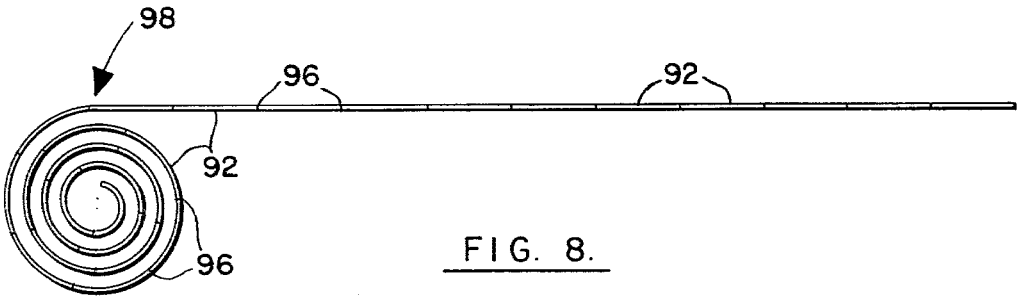
FIG. 8 is a side view of a series of the containers of FIG. 7 separated by perforations and forming a roll.

FIGS. 8 and 9 show a series of packets 92 separated by perforations 96 and forming a roll 98 of disposable dental wipe packets 92.

Figure 11:
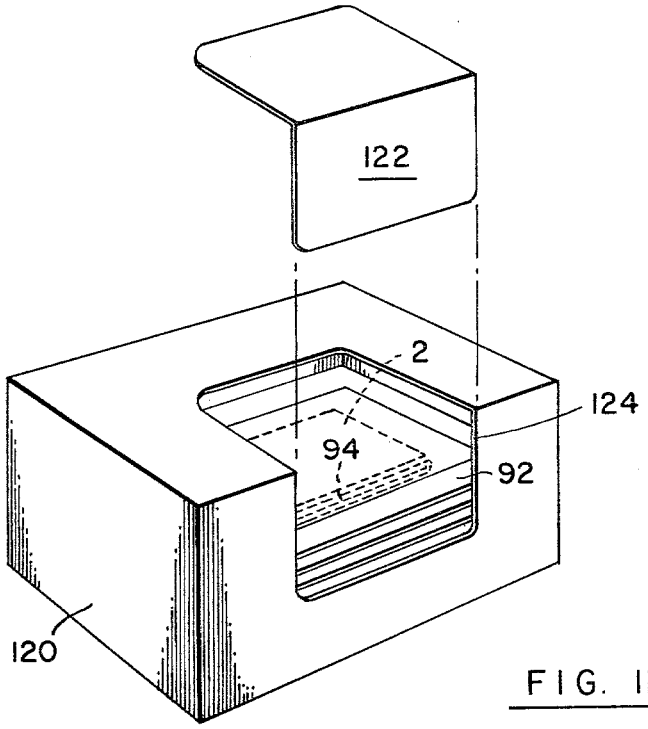
FIG. 11 is an exploded front perspective view of a dispensing container for the packaged dental wipes of FIG. 7.

As seen in FIG. 11, packets 92 may be shipped in and dispensed from a dispensing container 120 of, for example, cardboard, having a removable portion 122 covering a dispensing opening 124 and connected to container 122 by conventional weakened lines (not shown).

Figure 12:
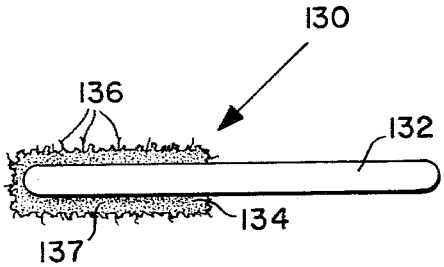
FIG. 12 is a bottom plan view of an alternative tooth cleaning device.
Figure 13:
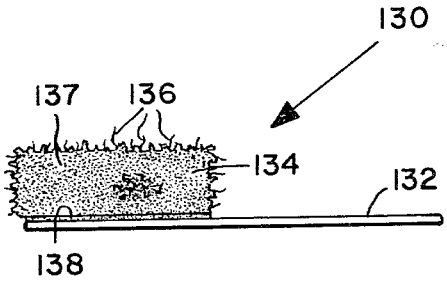
FIG. 13 is a side elevation of the device of FIG. 12.
Figure 14:
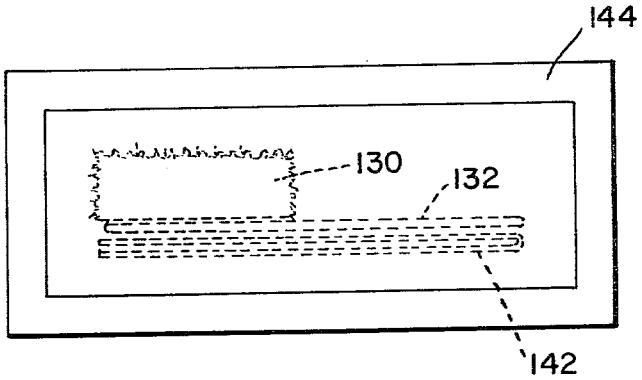
FIG. 14 is a plan view of the tooth cleaning device of FIGS. 12 and 13 enclosed within a sterile packet which also encloses a piece of dental floss.

Adverting to FIGS. 12 and 13, a disposable tooth cleaning device 130 has a semi-rigid rod 132 to which is attached a block 134 of reticulated polyurethane foam with bristles 136 and impregnated with a dentifrice paste 137. Block 134 is secured to rod 132 by an adhesive 138. Device 130 is particularly useful for people with finger incapacities such as infections and painful digits. It may be packaged with a length of dental floss 142 in a sterile packet 144 as seen in FIG. 14.

The above-described cleaning devices are readily made of flexible and resilient reticulated or non-reticulated polyurethane foam available commercially from a large number of manufacturers, for example, Scott Paper Co., Foam Division, Eddystone, Pennsylvania and Mobay Chemical Corp. of Pittsburgh, Pennsylvania. For details on such polyurethane foams, reference may be had to *Modern Plastics Encyclopedia*, 1977–78, published by McGraw-Hill, *Handbook of Foamed Plastics*, published by Lake Publishing Corp. of Libertyville, Illinois, and *Encyclopedia of Polymer Science and Technology*, H. F. Mark, N. G. Gaylord and N. B. Bikales (1969), which are incorporated herein by reference. The bristles integral with the polyurethane fibers are readily provided by cutting through the pore dimensions creating a protruding single polymeric unit at each side of the polyurethane unit.

Disposable dental wipes of the present ivention are more sanitary than toothbrushes since they are designed for one-time use and are disposed thereafter. Also, each wipe may contain a piece of dental floss which reminds the user to clean his or her interdental areas more thoroughly.

Sensory pressure nerve endings in the finger used to motor the dental wipe quantitate pressure at the time of cleaning which help to prevent enamel erosion and cementum abrasion, frequent complications of toothbrush cleaning.

Figure 15:
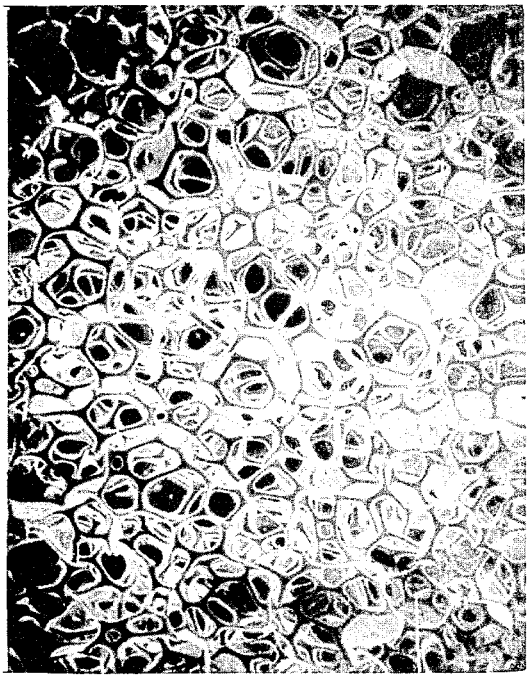
FIG. 15 is a magnified elevational view of reticulated polyurethane foam.
Figure 16:
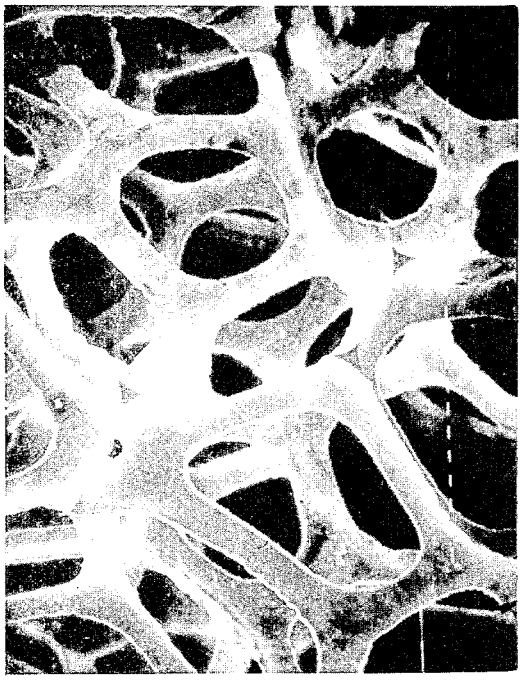
FIG. 16 is a more highly magnified elevational view of reticulated polyurethane foam.
Figure 17:
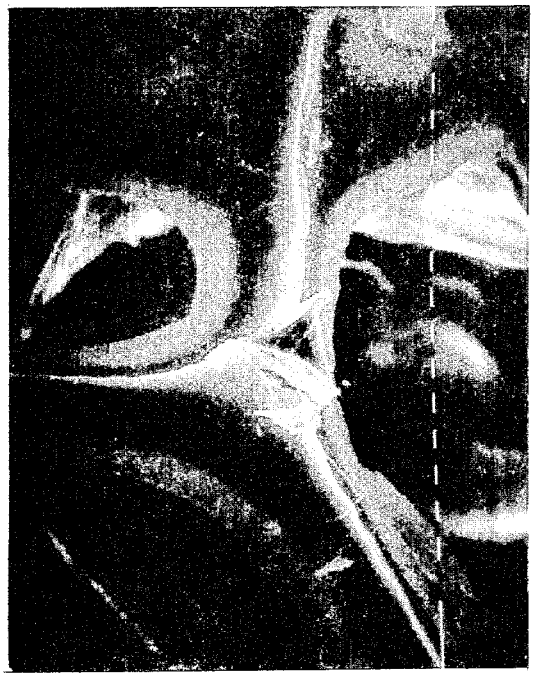
FIG. 17 is a still more highly magnified elevational view of reticulated polyurethane foam.

Polyurethane foam has large empty pores (see magnified views of foam in FIGs. 15–17) adapted for better absorption of a dentifrice, the material being, for example, 97% air and 3% material. The dental wipe of the present invention may be supplied in different colors, sizes, textures and of varying thicknesses. This enables each member of a family to have their own particular color and dimension for personal identification.

Figure 10:
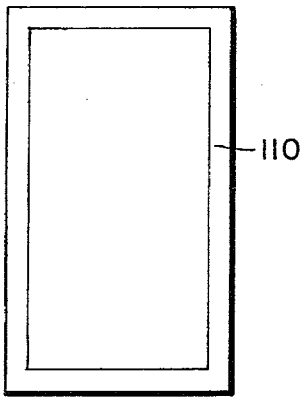
FIG. 10 is a plan view of a packet of water for mouth rinsing.

It should be pointed out that the prime material suggested for this mechanical device for cleaning teeth is composed of reticulated polyurethane foam or non-reticulated polyurethane foam or a combination of both, but similar polymeric materials or other similar materials may be substituted. Also, the materials so described may or may not be impregnated with a dentifrice of different colors, different flavors or different aromas. The individual dental wipes may be packaged individually or in bulk. Also, it should be pointed out that each dental wipe unit may be packaged with a packet of water 110 (FIG. 10) for mouth rinsing, also a towel for cleaning in a package for the camper or traveler.

I claim:

1. A disposable dental wipe for dental hygiene adapted to be wrapped around a finger for better sensitivity and pressure control against the teeth and gums, comprising a flexible honeycombed flat sheet of soft foam material having outer and inner faces and formed of a flexible resilient material, bristles integral with said material and extending outwardly from the outer face of said sheet, said bristles extending from all over the outer face of said sheet, said material being polyurethane or a polymeric-like material, a stripe of contact adhesive means mounted on the sheet for adhesively securing the material when it is wrapped around a finger, said sheet being impregnated with a dentifrice, said dentifrice being adapted to flow through the sheet upon application of pressure with the finger against teeth and gums, whereby said disposable dental wipe may be wrapped around a finger and may be directed and pressed by the finger in-between teeth, in back of a row of teeth, and against gums and teeth with finger sensitivity to provide a positive wiping force but tend to prevent the use of too great a force that would cause tooth enamel and gum deterioration.

2. The disposable dental wipe of claim 1, said sheet containing between about 10 to 100 cells per 1 linear inch, said material being largely open space of about 97% open space to 3% actual material.

3. The disposable dental wipe of claim 1, with each pore of the honeycombed sheet having a maximum dimension of from about 0.2 to about 6 mm, and each bristle having a length of about 0.1 to about 3 mm.

4. The disposable dental wipe of claim 1, with each pore of the honeycombed sheet having a maximum dimension of from about 0.5 to about 4 mm, and each bristle having a length of about 0.4 mm to about 2 mm.

5. A disposable dental wipe for dental hygiene adapted to be wrapped around a finger for better sensitivity and pressure control against the teeth and gums, comprising a flexible honeycombed flat sheet of soft foam material having outer and inner faces and formed of a flexible resilient material, bristles integral with said material and extending outwardly from the outer face of said sheet, said bristles extending from all over the outer face of said sheet, said material being polyurethane or a polymeric-like material, said sheet being adapted for use as a flat sheet with several fingers pressing it against the front teeth of the user, said sheet being sufficiently wide to wrap around a finger of the user and sufficiently long to cover a substantial length of the finger, said sheet being sufficiently flexible to stretch and closely conform to the contours of the surface of the finger along its length especially the tip of the finger for better sensitivity and feedback from the finger to better feel the crevices of the teeth and to better feel between the teeth to feel how clean the user is getting the teeth, said sheet being sufficiently thin and flexible to snugly fit and closely conform to the contours of a finger of any size, said sheet being sufficiently flexible to permit bending of the finger and of the sheet, said sheet being of sufficiently soft foam material to provide more accurate control of the finger pressure used to clean the teeth, a stripe of contact adhesive means mounted on the sheet for adhesively securing the material when it is wrapped around a finger, said sheet being impregnated with a dentifrice, said dentifrice being adapted to flow through the sheet upon application of pressure with the finger against teeth and gums, whereby said disposable dental wipe may be used as a flat sheet with several fingers pressing it against the front teeth of the user and may be wrapped around a finger and may be directed and pressed by the finger in-between teeth, in back of a row of teeth, and against gums and teeth with finger sensitivity to provide a positive wiping force but tend to prevent the use of too great a force that would cause tooth enamel and gum deterioration.

* * * * *